US011214073B2

(12) United States Patent
Suyama et al.

(10) Patent No.: US 11,214,073 B2
(45) Date of Patent: Jan. 4, 2022

(54) PRINTING APPARATUS AND A LIQUID CIRCULATION METHOD IN A PRINTING APPARATUS

(71) Applicant: SCREEN HOLDINGS CO., LTD., Kyoto (JP)

(72) Inventors: Tadayoshi Suyama, Kyoto (JP); Koji Furuichi, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/017,185

(22) Filed: Sep. 10, 2020

(65) Prior Publication Data

US 2021/0086520 A1 Mar. 25, 2021

(30) Foreign Application Priority Data

Sep. 20, 2019 (JP) ..... JP2019-171158

(51) Int. Cl.
*B41J 2/18* (2006.01)
*B41J 2/175* (2006.01)

(52) U.S. Cl.
CPC ..... *B41J 2/18* (2013.01); *B41J 2/17596* (2013.01)

(58) Field of Classification Search
CPC . B41J 2/18; B41J 2/17596; B41J 2/175; B41J 2202/12
USPC ..... 347/6, 7, 84, 85, 89
See application file for complete search history.

(56) References Cited

U.S. PATENT DOCUMENTS

| | | | |
|---|---|---|---|
| 8,366,224 | B2 | 2/2013 | Yokota et al. |
| 9,085,163 | B2 | 7/2015 | Sunouchi et al. |
| 9,498,971 | B2 | 11/2016 | Matsushima |
| 10,259,246 | B2 | 4/2019 | Sawase |
| 2009/0102879 | A1 | 4/2009 | Katada et al. |
| 2011/0316904 | A1 | 12/2011 | Isozaki et al. |

FOREIGN PATENT DOCUMENTS

| | | | |
|---|---|---|---|
| EP | 2 977 210 | A1 | 1/2016 |
| EP | 3 437 884 | A1 | 2/2019 |
| JP | 2009-101516 | A | 5/2009 |
| WO | 2006/064036 | A1 | 6/2006 |
| WO | 2006/075314 | A2 | 7/2006 |

OTHER PUBLICATIONS

Extended European Search Report issued in corresponding European Patent Application No. 20194971.6-1017, dated Jan. 22, 2021.

*Primary Examiner* — An H Do
(74) *Attorney, Agent, or Firm* — McDermott Will & Emery LLP

(57) ABSTRACT

The liquid L flowed into the bypass communication pipe 93 from the feed reservoir 91*f* can be returned to the feed reservoir 91*f* by way of the return reservoir 91*r* by carrying out the bypass circulation of circulating the liquid L along the bypass circulation channel Cb. Since this bypass communication pipe 93 bypasses the discharge heads H, the liquid L does not pass through the discharge heads H in the bypass circulation. As a result, the liquid L can be circulated between the feed reservoir 91*f* and the return reservoir 91*r* while the mixing of foreign substances into the discharge heads H from the respective reservoirs 91*f*, 91*r* is suppressed.

3 Claims, 12 Drawing Sheets

FIG. 8

| | OPEN TO ATMOSPHERIC PRESSURE | NEGATIVE PRESSURE DIFFERENCE | MAIN VALVE | BYPASS VALVE | HEAD VALVE | PURGE |
|---|---|---|---|---|---|---|
| START | × | ○ | ○ | × | ○ | × |
| S101 | × | × | ○ | × | ○ | × |
| S102 | × | × | ○ | × | × | × |
| S103 | × | × | ○ | ○ | × | × |
| S104 | ○ | × | × | ○ | × | × |
| S105 | ○ | × | × | ○ | × | × |
| S106 | ○ | × | ○ | ○ | × | × |
| S107 | × | ○ | ○ | ○ | × | × |
| S108 | × | ○ | ○ | ○ | × | × |
| S109 | × | × | ○ | ○ | × | × |
| S110 | × | × | ○ | × | ○ | × |
| S111 | × | × | ○ | × | ○ | ○ |
| S112 | × | ○ | ○ | × | ○ | × |
| S113 | × | ○ | ○ | × | ○ | × |

PRINTING APPARATUS AND A LIQUID CIRCULATION METHOD IN A PRINTING APPARATUS

CROSS REFERENCE TO RELATED APPLICATION

The disclosure of Japanese Patent Application No. 2019-171158 filed on Sep. 20, 2019 including specification, drawings and claims is incorporated herein by reference in its entirety.

BACKGROUND OF THE INVENTION

1. Field of the Invention

This invention relates to a technique for liquid replacement in a channel which supplies a liquid in a circulating manner to a discharge head which discharges the liquid from a nozzle.

2. Description of the Related Art

Conventionally, a printing apparatus is known which performs printing by discharging an ink (liquid) from a nozzle of a discharge head by an inkjet method. Further, a printing apparatus described in JP 2009-101516A includes a supply tank which supplies an ink to a discharge head and a recovery tank which recovers the ink from the discharge head, and the ink is circulated between the supply tank and the recovery tank by returning the ink, which is flowed from the supply tank into the recovery tank via the discharge head, to the supply tank.

SUMMARY OF THE INVENTION

At the time of printing, the liquid can be discharged from the nozzle of the discharge head while the liquid is successively supplied to the discharge head by circulating the liquid in the above circulation channel. On the other hand, it has not necessarily been appropriate to circulate the liquid between a feed reservoir (supply tank) and a return reservoir (recovery tank) by the above circulation channel at the time of maintenance or the like besides printing. This is because minute foreign substances may be gradually generated from the liquid due to a load (e.g. a load by pumping) applied to the liquid by continuing to circulate the liquid. Thus, if the liquid is circulated in the above circulation channel, foreign substances may be mixed into the discharge head.

This invention was developed in view of the above problem and aims to provide a technique capable of circulating a liquid between a feed reservoir and a return reservoir while suppressing the mixing of foreign substances into a discharge head.

A printing apparatus according to the invention 1, comprises: a feed reservoir; a discharge head which discharges a liquid supplied from the feed reservoir via a feed channel from a nozzle; a return reservoir which recovers the liquid from the discharge head via a return channel; a bypass channel configured to feed the liquid from the feed reservoir to the return reservoir by bypassing the discharge head; a liquid feed unit which performs a first liquid feeding operation of feeding the liquid from the feed reservoir to the return reservoir; and a control unit which selectively carries out a normal circulation of returning the liquid flowed into the discharge head from the feed reservoir to the feed reservoir by way of the return reservoir by causing the liquid feed unit to perform the first liquid feeding operation with the feed channel and the return channel opened while the bypass channel is closed and a bypass circulation of returning the liquid flowed into the bypass channel from the feed reservoir to the feed reservoir by way of the return reservoir by causing the liquid feed unit to perform the first liquid feeding operation with the bypass channel opened while the feed channel and the return channel are closed.

A liquid circulation method according to the invention in a printing apparatus for supplying a liquid from a feed reservoir via a feed channel to a discharge head which discharges the liquid and recovering the liquid from the discharge head via a return channel to a return reservoir, comprises: carrying out a normal circulation of returning the liquid flowed into the discharge head from the feed reservoir to the feed reservoir by way of the return reservoir with the feed channel and the return channel opened while a bypass channel which feeds the liquid from the feed reservoir to the return reservoir by bypassing the discharge head is closed; and carrying out a bypass circulation of returning the liquid flowed into the bypass channel from the feed reservoir to the feed reservoir by way of the return reservoir with the bypass channel opened while the feed channel and the return channel are closed.

In the invention (printing apparatus, liquid circulation method in the printing apparatus) thus configured, the liquid flowed into the discharge head from the feed reservoir can be returned to the feed reservoir by way of the return reservoir by carrying out the normal circulation. Thus, the liquid circulated by the normal circulation can be discharged from the nozzle of the discharge head at the time of normal printing. On the other hand, the liquid flowed into the bypass channel from the feed reservoir can be returned to the feed reservoir by way of the return reservoir by carrying out the bypass circulation. Since this bypass channel bypasses the discharge head, the liquid does not pass through the discharge head in the bypass circulation. As a result, the liquid can be circulated between the feed reservoir and the return reservoir while the mixing of foreign substances into the discharge head from the respective reservoirs is suppressed.

As described above, according to the invention, it is possible to circulate the liquid between the feed reservoir and the return reservoir while suppressing the mixing of foreign substances into the discharge head from the respective reservoirs.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 8 is a table showing contents set by the controller of the liquid supply device in each step of the liquid replacing operation of FIG. 7.

DETAILED DESCRIPTION OF THE PREFERRED EMBODIMENTS

Figure 1:
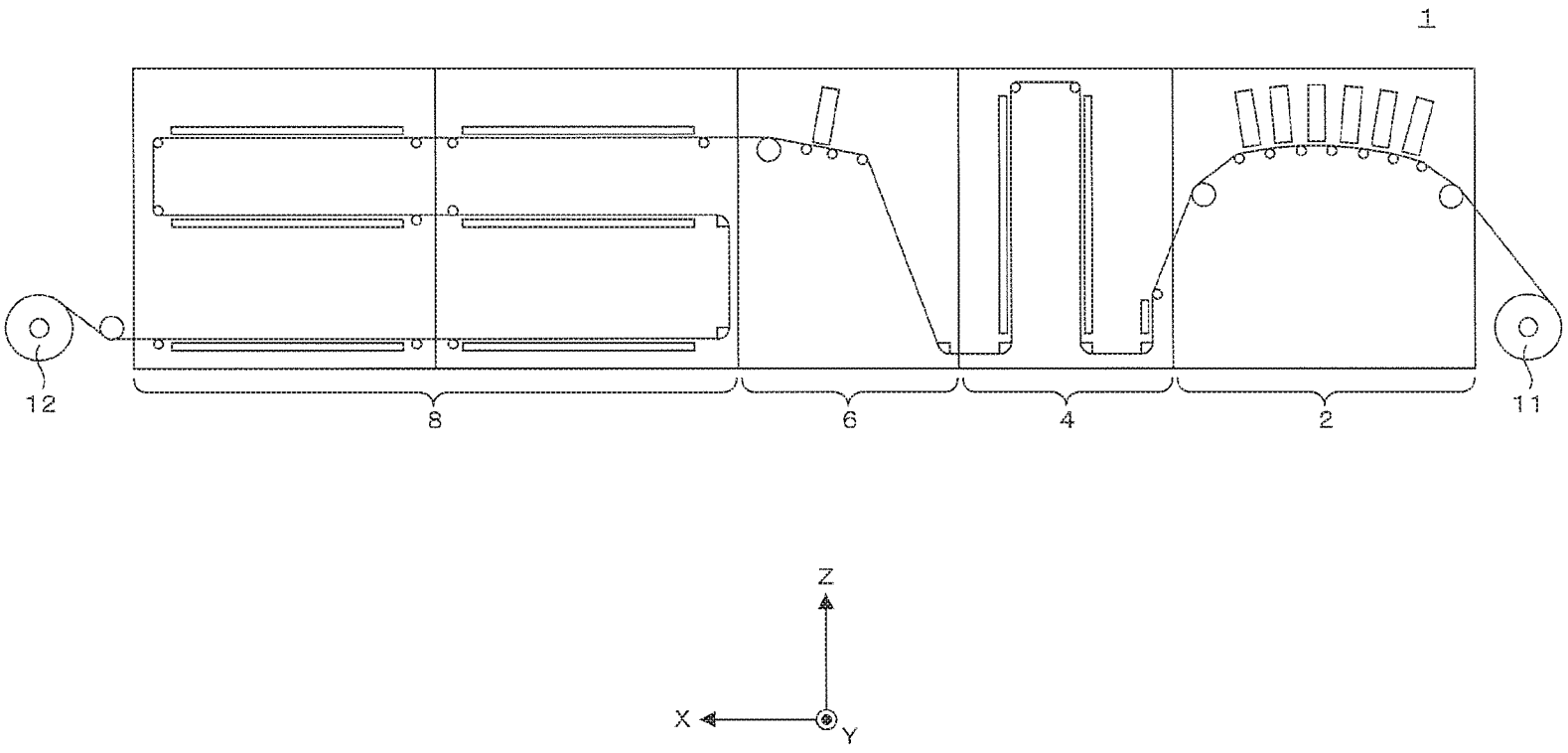
FIG. 1 is a front view schematically showing a printing system with printing apparatuses according to the invention.

FIG. 1 is a front view schematically showing a printing system with printing apparatuses according to the invention. In FIG. 1 and subsequent figures, an X direction, a Y direction and a Z direction orthogonal to each other are shown as appropriate. Here, the X direction and the Y direction are respectively horizontal directions and the Z direction is a vertical direction. As shown in FIG. 1, the printing system 1 comprises a pre-stage printing apparatus 2, a pre-stage drier 4, a post-stage printing apparatus 6 and a post-stage drier 8 which have the same height and are arranged in this order. This printing system 1 causes the pre-stage drier 4 to dry a printing medium M to which a printing has been executed by the pre-stage printing apparatus 2 and causes the post-stage drier 8 to dry the printing medium M to which a printing has been executed by the post-stage printing apparatus 6 while the printing medium M is conveyed in a roll-to-roll manner from a feed roll 11 to a wind-up roll 12. Here, a case where a printing is executed to the printing medium M, which is a transparent film, with water-based inks is illustrated and described. Further, out of both surfaces of the printing medium M, the surface on which an image is to be printed is referred to as a front surface and the surface opposite to the front surface is referred to as a back surface as appropriate.

Figure 2:
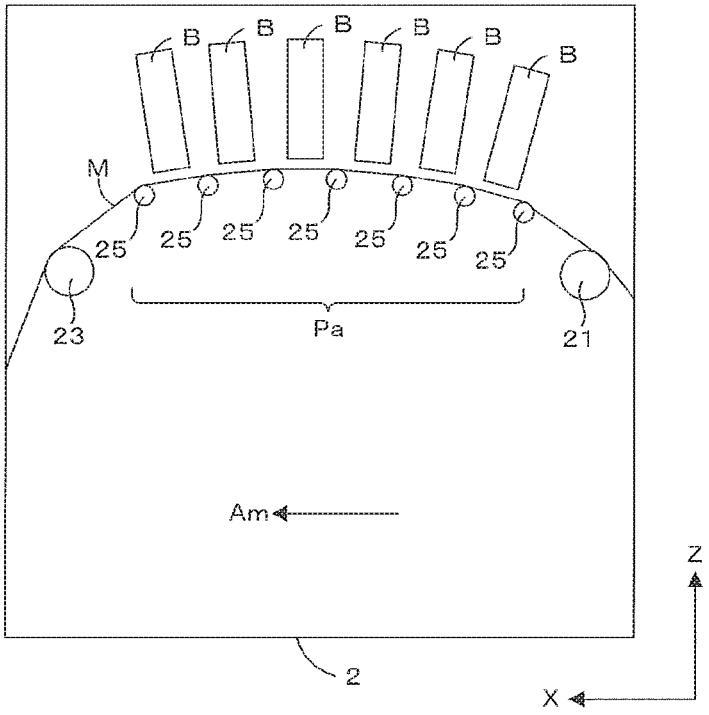
FIG. 2 is a front view schematically showing the pre-stage printing apparatus provided in the printing system of FIG. 1.

FIG. 2 is a front view schematically showing the pre-stage printing apparatus provided in the printing system of FIG. 1. In the pre-stage printing apparatus 2, the printing medium M is conveyed along a conveying direction Am from left to right of FIG. 2. This pre-stage printing apparatus 2 includes a carry-in roller 21 which carries in the printing medium M fed from the feed roll 11 and a carry-out roller 23 which carries out the printing medium M toward the pre-stage drier 4. The back surface of the printing medium M is wound by the carry-in roller 21 and the carry-out roller 23 from below and driven in the conveying direction Am by the carry-in roller 21 and the carry-out roller 23. Further, the pre-stage printing apparatus 2 includes a plurality of backup rollers 25 arranged between the carry-in roller 21 and the carry-out roller 23 in the conveying direction Am. The back surface of the printing medium M being conveyed in the conveying direction Am is wound from below by each of these backup rollers 25 supporting the printing medium M.

A pre-stage printing path Pa is formed between the most upstream backup roller 25 and the most downstream backup roller 25 in the conveying direction Am, out of the plurality of backup rollers 25. The most upstream and most downstream backup rollers 25 support the printing medium M at the same height, and the backup rollers 25 more inward of the pre-stage printing path Pa support the printing medium M at higher positions.

Further, the pre-stage printing apparatus 2 includes a plurality of print bars B arranged in the conveying direction Am above the printing medium M being conveyed along the pre-stage printing path Pa and facing the front surface of the printing medium M. Specifically, the print bar B is arranged to face the front surface of a part of the printing medium M moving between two adjacent backup rollers 25, and each print bar B discharges an ink in an inkjet method to the front surface of a part of the printing medium M having both sides supported by two backup rollers 25 in this way. In an example shown here, there are provided six print bars B including four print bars B which discharge inks of four process colors (yellow, magenta, cyan, black) and two print bars B which discharge two special color inks (orange, violet). Therefore, the pre-stage printing apparatus 2 can print a color image on the front surface of the printing medium M by the six print bars B which discharge the color inks having mutually different colors.

The printing medium M having the image printed in the pre-stage printing path Pa moves obliquely downward between the most downstream backup roller 25 of the pre-stage printing path Pa and the carry-out roller 23 and reaches the carry-out roller 23. The back surface of the printing medium M is wound by the carry-out roller 23 from below on a side downstream of the plurality of backup rollers 25 in the conveying direction Am. Then, the carry-out roller 23 carries out the printing medium M to the pre-stage drier 4. Note that the carry-out roller 23 is a suction roller which sucks the back surface of the printing medium M and stabilizes the position of the printing medium M in the pre-stage printing path Pa by suppressing the transmission of the vibration of the printing medium M from the pre-stage drier 4 to the pre-stage printing apparatus 2. As a result, the influence of the conveyance of the printing medium M in the pre-stage drier 4 on printing in the pre-stage printing apparatus 2 can be suppressed.

As shown in FIG. 1, the pre-stage drier 4 dries the printing medium M while appropriately folding the conveying direction Am of the printing medium M in the Z direction. Then, the printing medium M dried in the pre-stage drier 4 is carried out to the post-stage printing apparatus 6 from the pre-stage drier 4.

Figure 3:
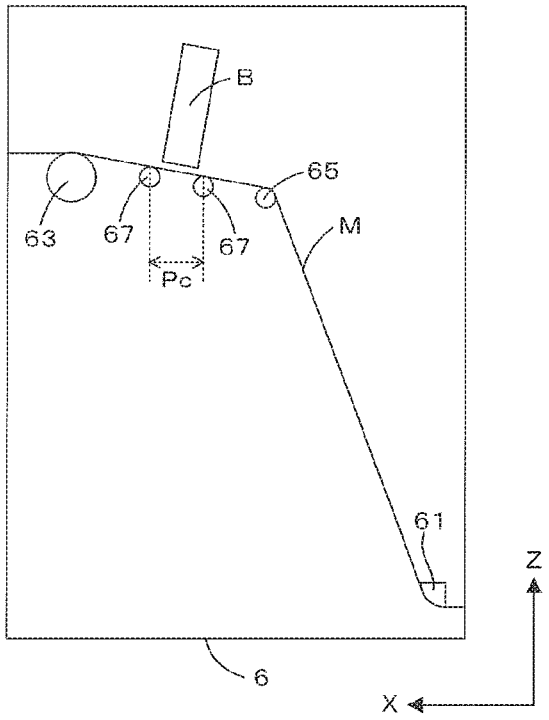
FIG. 3 is a front view schematically showing the post-stage printing apparatus provided in the printing system of FIG. 1.

FIG. 3 is a front view schematically showing the post-stage printing apparatus provided in the printing system of FIG. 1. The post-stage printing apparatus 6 includes an air turn bar 61 which folds the printing medium M carried out in the X direction from the pre-stage drier 4 obliquely upwardly. The front surface of the printing medium M is wound by this air turn bar 61 while a clearance is providing between the front surface of the printing medium M and the air turn bar 61 by injecting air. Further, the post-stage printing apparatus 6 includes a carry-out roller 63 for carrying out the printing medium M toward the post-stage drier 8 and a conveyor roller 65 arranged between the air turn bar 61 and the carry-out roller 63. The back surface of the printing medium M is wound from below by the conveyor roller 65 and the carry-out roller 63 and the printing medium M is driven in the conveying direction by the conveyor roller 65 and the carry-out roller 63.

Further, the post-stage printing apparatus 6 includes two backup rollers 67 between the conveyor roller 65 and the carry-out roller 63. A post-stage printing path Pc is formed between the two backup rollers 67. Further, the post-stage printing apparatus 6 includes a print bar B facing the front surface of the printing medium M above the printing medium M being conveyed along the post-stage printing path Pc. Specifically, the print bar B is arranged to face a part of the printing medium M moving between the two backup rollers 67, and discharges an ink in the inkjet method to the front surface of the part of the printing medium M having both sides supported by the two backup rollers 67. In an example shown here, the print bar B discharges a white ink. Therefore, the post-stage printing apparatus 6 can print a white background image on the front surface of the printing medium M by the print bar B with respect to the color image printed in the pre-stage printing apparatus 2.

The printing medium M having the image printed in the post-stage printing path Pc moves obliquely upward between the most downstream backup roller 67 of the post-stage printing path Pc and the carry-out roller 63 and reaches the carry-out roller 63. The printing medium M is wound by this carry-out roller 63 from below on a side downstream of the two backup rollers 67 in the conveying direction Am. The carry-out roller 63 carries out the printing medium M to the post-stage drier 8 along a moving path of the printing medium M in the X direction by winding the printing medium M obliquely moving upward from the post-stage printing path Pc in this way. Note that the carry-out roller 63 is a suction roller which sucks the back surface of the printing medium M and stabilizes the position of the printing medium M in the post-stage printing path Pc by suppressing the transmission of the vibration of the printing medium M from the post-stage drier 8 to the post-stage printing apparatus 6. As a result, the influence of the conveyance of the printing medium M in the post-stage drier 8 on printing in the post-stage printing apparatus 6 can be suppressed.

As shown in FIG. 1, the post-stage drier 8 dries the printing medium M while appropriately folding the conveying direction Am of the printing medium M in the X direction. Then, the printing medium M dried in the post-stage drier 8 is carried out from the post-stage drier 8 and wound on the wind-up roll 12.

As described above, the print bars B provided in the pre-stage printing apparatus 2 and the post-stage printing apparatus 6 discharge the liquids (inks) in the inkjet method. Specifically, a plurality of discharge heads H (FIGS. 4 and 5) which discharge the liquid from a plurality of nozzles N arrayed in the Y direction to the printing medium M are arrayed in the Y direction in a bottom part of the print bar B.

Figure 4:
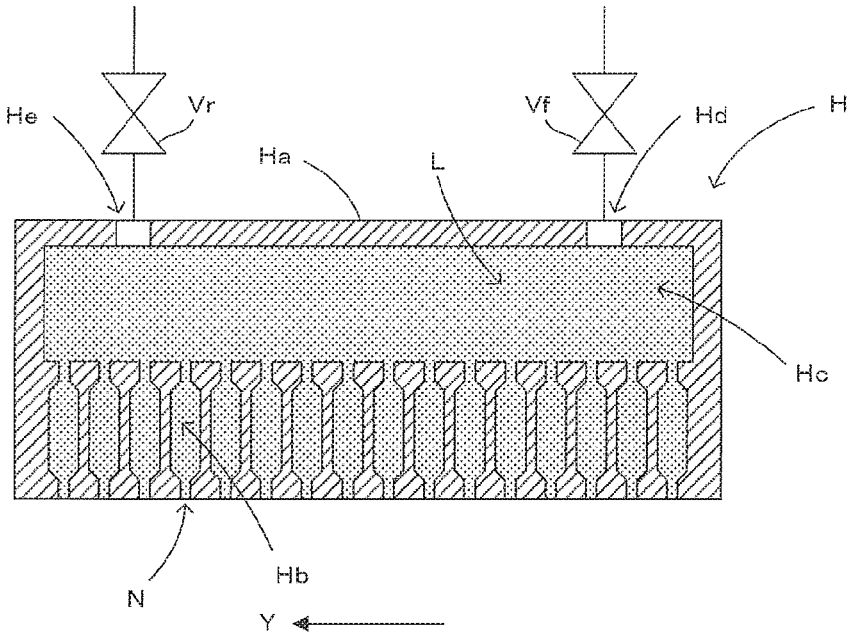
FIG. 4 is a diagram schematically showing the configuration of the discharge head.

FIG. 4 is a diagram schematically showing the configuration of the discharge head. As shown in FIG. 4, the discharge head H includes a housing Ha and the plurality of nozzles N are arrayed in the Y direction and open in a bottom part of the housing Ha. A plurality of cavities Hb respectively communicating with the plurality of nozzles N and a liquid supply chamber Hc communicating with the plurality of cavities Hb are provided inside the housing Ha, and a liquid L supplied from the liquid supply chamber Hc is stored in the cavities Hb. Then, piezoelectric elements provided in the cavities Hb push the liquid L from the cavities Hb, whereby the liquid L is discharged from the nozzles N communicating with the cavities Hb. Note that a specific method for discharging the liquid L is not limited to a method by the piezoelectric elements and may be a thermal method for heating the liquid L. Further, a liquid supply port Hd and a liquid recovery port He are respectively open in an upper part of the discharge head H, and the liquid L is supplied to the liquid supply chamber Hc via the liquid supply port Hd and recovered from the liquid supply chamber Hc via the liquid recovery port He.

Figure 5:
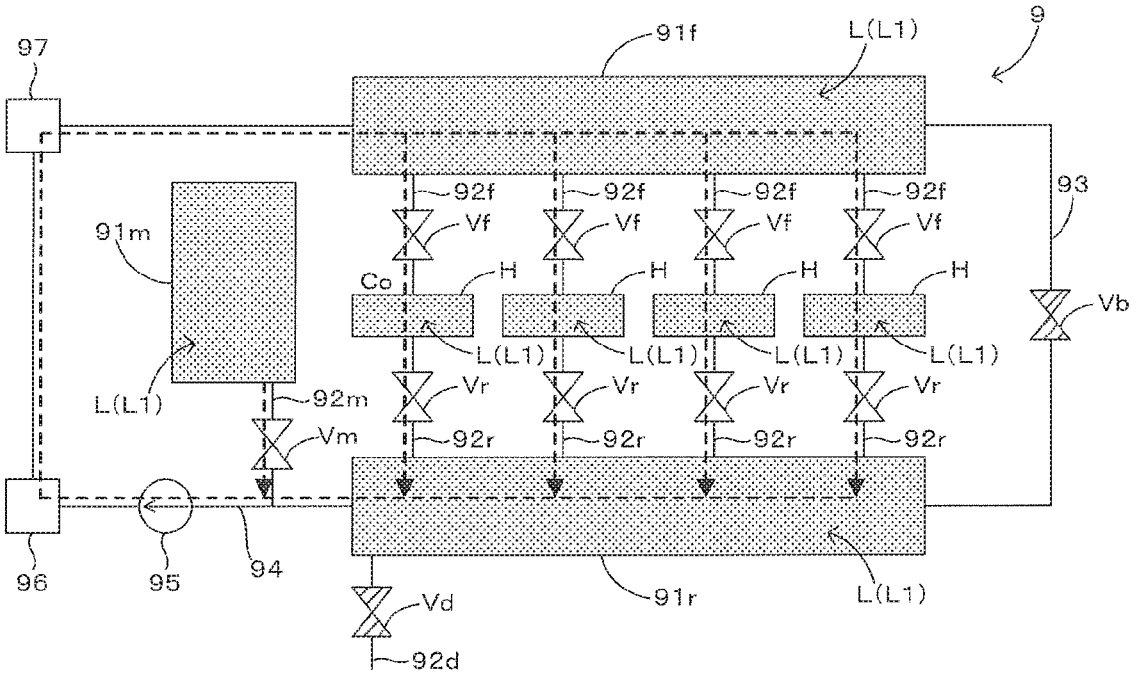
FIG. 5 is a diagram schematically showing the configuration of a liquid supply device which supplies the liquid to the discharge heads of FIG. 4.
Figure 6:
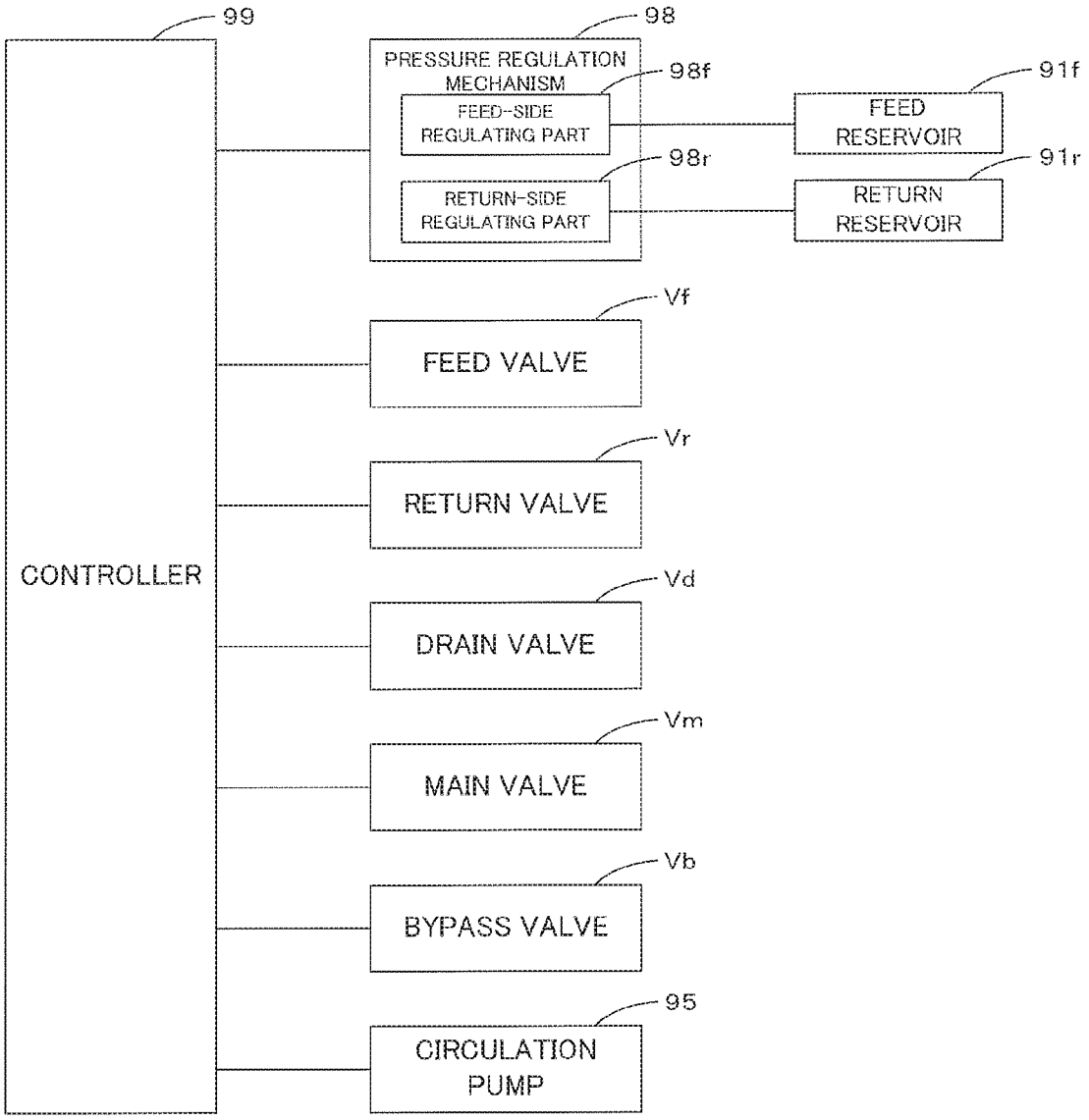
FIG. 6 is a block diagram showing a control mechanism provided in the liquid supply device of FIG. 5.

FIG. 5 is a diagram schematically showing the configuration of a liquid supply device which supplies the liquid to the discharge heads of FIG. 4, and FIG. 6 is a block diagram showing a control mechanism provided in the liquid supply device of FIG. 5. In FIG. 5, the liquid L present in the liquid supply device 9 is shown by dotted hatching. Each of the pre-stage printing apparatus 2 and the post-stage printing apparatus 6 includes the liquid supply device 9 for each print bar B. However, since the configuration of the liquid supply device 9 is common in each print bar B, the configuration of the liquid supply device 9 for one print bar B is described here.

The liquid supply device 9 includes a feed reservoir 91*f* which stores the liquid L and feed pipes 92*f* (feed channels) connecting the feed reservoir 91*f* and the liquid supply ports Hd of the discharge heads H. The liquid L supplied from the feed reservoir 91*f* to the feed pipes 92*f* flows into the liquid supply chambers Hc via the liquid supply ports Hd. Further, the liquid supply device 9 includes a return reservoir 91*r* which stores the liquid L and return pipes 92*r* (return channels) connecting the return reservoir 91*r* and the liquid recovery ports He of the discharge heads H. The liquid L flowed into the return pipes 92*r* from the liquid supply chambers Hc of the discharge heads H via the liquid recovery ports He is recovered into the return reservoir 91*r*.

As just described, in the liquid supply device 9, the liquid L is supplied to the discharge heads H from the feed reservoir 91*f* via the feed pipes 92*f*, and recovered into the return reservoir 91*r* from the discharge heads H via the return pipes 92*r*. That is, channels of the liquid L from the feed reservoir 91*f* to the return reservoir 91*r* by way of the discharge heads H are provided. In contrast, the liquid supply device 9 includes a bypass communication pipe 93 (bypass channel) provided in parallel to the discharge heads H between the feed reservoir 91*f* and the return reservoir 91*r*. That is, the bypass communication pipe 93 is a pipe allowing communication between the feed reservoir 91*f* and the return reservoir 91*r* by bypassing the discharge heads H (i.e. without by way of the discharge heads H), and the liquid L moves in the bypass communication pipe 93 from the feed reservoir 91*f* toward the return reservoir 91*r*.

Further, the liquid supply device 9 includes a reservoir communication pipe 94 (common channel) connecting the return reservoir 91*r* and the feed reservoir 91*f*. This reservoir communication pipe 94 is a pipe allowing communication between the return reservoir 91*r* and the feed reservoir 91*f*, and the liquid L moves in the reservoir communication pipe 94 from the return reservoir 91*r* toward the feed reservoir 91*f*.

A circulation pump 95, a filter 96 and a degasser 97 are provided to the reservoir communication pipe 94. The circulation pump 95, the filter 96 and the degasser 97 are arranged in this order in a flowing direction of the liquid L in the reservoir communication pipe 94. The circulation pump 95 functions to feed the liquid L flowing out from the return reservoir 91*r* to the feed reservoir 91*f* along the reservoir communication pipe 94. The filter 96 removes solids from the liquid L flowing in the reservoir communication pipe 94 before flowing into the feed reservoir 91*f*, and the degasser 97 removes gases from the liquid L flowing in the reservoir communication pipe 94 before flowing into the feed reservoir 91*f*.

Further, the liquid supply device 9 includes a main reservoir 91*m* capable of storing a large amount of the liquid L, and a liquid supply pipe 92*m* connecting the main reservoir 91*m* and the reservoir communication pipe 94. Specifically, the liquid supply pipe 92*m* connects a part of the reservoir communication pipe 94 between the return reservoir 91*r* and the circulation pump 95 and the main reservoir 91*m*. The liquid L stored in the main reservoir 91*m* is supplied into the reservoir communication pipe 94 via the liquid supply pipe 92*m*.

Furthermore, the liquid supply device 9 includes a pressure regulation mechanism 98 which regulates pressures to be respectively applied to the feed reservoir 91*f* and the return reservoir 91*r*. This pressure regulation mechanism 98 includes a feed-side regulating part 98*f* which regulates the pressure to be applied to the feed reservoir 91*f* and a return-side regulating part 98*r* which regulates the pressure to be applied to the return reservoir 91*r*. These feed-side regulating part 98*f* and the return-side regulating part 98*r* have a common configuration and respectively apply negative pressures generated in negative pressure tanks by decompressing the negative pressure tanks by negative pressure pumps to the feed reservoir 91*f* and the return reservoir 91*r*.

Further, the liquid supply device 9 includes various valves Vf, Vr, Vd, Vm and Vb (electromagnetic valves). The feed valves Vf are provided to the feed pipes 92*f*. If the feed valve Vf is opened, a movement of the liquid L between the feed reservoir 91*f* and the discharge head H via the feed pipe 92*f* is allowed. If the feed valve Vf is closed, the movement of the liquid L between the feed reservoir 91*f* and the discharge head H via the feed pipe 92*f* is prohibited.

The return valves Vr are provided to the return pipes 92*r*. If the return valve Vr is opened, a movement of the liquid L between the return reservoir 91*r* and the discharge head H via the return pipe 92*r* is allowed. If the return valve Vr is closed, the movement of the liquid L between the return reservoir 91*r* and the discharge head H via the return pipe 92*r* is prohibited.

The drain valve Vd is provided to a drain pipe 92*d* connected to the return reservoir 91*r*. If the drain valve Vd is opened, the liquid L in the return reservoir 91*r* is drained from the drain pipe 92*d*. If the drain valve Vd is closed, the drain of the liquid L from the return reservoir 91*r* via the drain pipe 92*d* is prohibited.

The main valve Vm is provided to the liquid supply pipe 92*m*. If the main valve Vm is opened, a movement of the liquid L from the main reservoir 91*m* to the reservoir communication pipe 94 via the liquid supply pipe 92*m* is allowed. If the main valve Vm is closed, the movement of the liquid L from the main reservoir 91*m* to the reservoir communication pipe 94 via the liquid supply pipe 92*m* is prohibited.

The bypass valve Vb is provided to the bypass communication pipe 93. If the bypass valve Vb is opened, a movement of the liquid L between the feed reservoir 91*f* and the return reservoir 91*r* via the bypass communication pipe 93 is allowed. If the bypass valve Vb is closed, the movement of the liquid L between the feed reservoir 91*f* and the return reservoir 91*r* via the bypass communication pipe 93 is prohibited.

Such a liquid supply device 9 includes a controller 99, which is a processor such as a CPU (Central Processing Unit). The controller 99 controls the various valves Vf, Vr, Vd, Vm and Vb, the circulation pump 95 and the pressure regulation mechanism 98 to control movements of the liquid L in the liquid supply device 9.

For example, out of the valves Vf, Vr, Vd, Vm and Vb, those hatched with oblique lines are closed and those not hatched are open in FIG. 5. That is, the bypass valve Vb and the drain valve Vd are closed, the feed valves Vf, the return valves Vr and the main valve Vm are open. In this state, the controller 99 can carry out a normal circulation of circulating the liquid L along a normal circulation channel Co shown by dotted lines.

In this normal circulation, the controller 99 causes the pressure regulation mechanism 98 to perform a first liquid feeding operation of feeding the liquid L from the feed reservoir 91*f* toward the return reservoir 91*r*. This first liquid feeding operation is a negative pressure difference applying operation of applying a pressure from the feed reservoir 91*f* toward the return reservoir 91*r* to the liquid L. That is, the pressure regulation mechanism 98 performs the negative pressure difference applying operation of regulating a pressure Pf in the feed reservoir 91*f* to a negative pressure by the feed-side regulating part 98*f* and regulating a pressure Pr in the return reservoir 91*r* to a negative pressure lower than the pressure Pf by the return-side regulating part 98*r* as the first liquid feeding operation. In this way, a negative pressure difference ΔP is generated between the pressure Pf in the feed reservoir 91*f* and the pressure Pr in the return reservoir 91*r*, and the pressure from the feed reservoir 91*f* toward the return reservoir 91*r* is applied to the liquid L. During the negative pressure difference applying operation, the controller 99 operates the circulation pump 95 and causes the circulation pump 95 to discharge the liquid L from the return reservoir 91*r* toward the feed reservoir 91*f*, whereby the liquid L is prevented from being excessively pooled in the return reservoir 91*r*.

At this time, the controller 99 opens the feed valves Vf and the return valves Vr while closing the bypass valve Vb. Accordingly, the liquid L is circulated along the normal circulation channel Co which returns from the return reservoir 91*r* to the feed reservoir 91*f* via the reservoir communication pipe 94 after reaching the return reservoir 91*r* from the feed reservoir 91*f* by way of the discharge heads H (normal circulation). Then, the discharge heads H perform printing by discharging the liquid L (ink) supplied along the circulation channel Co from the nozzles N.

In the liquid supply device 9 as described above, it is necessary as appropriate to perform a liquid replacing operation of replacing the liquid L in the liquid supply device 9. For example, the printing apparatus such as the pre-stage printing apparatus 2 or the post-stage printing apparatus 6 may be shipped from a factory with a solvent of the ink filled instead of the ink. In such a case, the liquid replacing operation is performed to replace the liquid L in the liquid supply device 9 from the solvent to the ink after the delivery to a user. Alternatively, in the case of changing the specification of the ink used in printing, the liquid replacing operation is performed to replace the ink from the ink before a specification change to the ink after the specification change.

Figure 7:
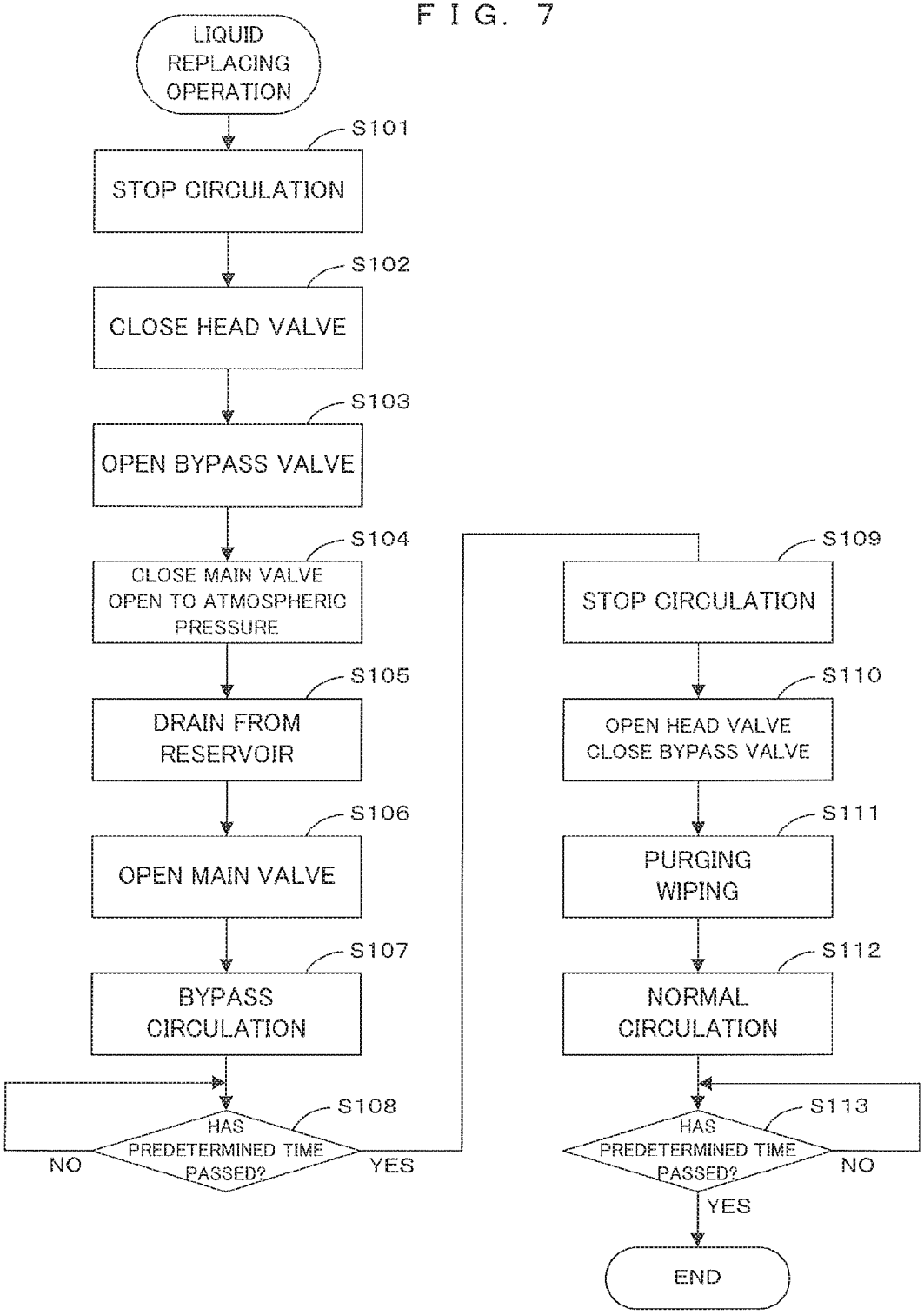
FIG. 7 is a flow chart showing an example of the liquid replacing operation.

FIG. 7 is a flow chart showing an example of the liquid replacing operation, FIG. 8 is a table showing contents set by the controller of the liquid supply device in each step of the liquid replacing operation of FIG. 7, and FIGS. 9 to 12 are diagrams schematically showing operations performed in the liquid replacing operation of FIG. 7. In FIGS. 9 to 12, out of the valves Vf, Vr, Vd, Vm and Vb, those hatched with oblique lines are closed and those not hatched are open. The liquid replacing operation shown in these figures is an operation of replacing the liquid L from a liquid L1 to a liquid L2, and performed by the control of the controller 99 of the liquid supply device 9. Here, the liquid L1 belongs to one type of the liquid L, and the liquid L2 belongs to another type (different from the one type) of the liquid L. In one example, the liquid L1 is a solvent and the liquid L2 is an ink. In another example, the specification of the liquid L1 and that of the liquid L2 are different.

First, FIG. 8 is described. In column "Open to Atmospheric Pressure", a mark "○" indicates a state where the pressure regulation mechanism 98 opens the feed reservoir 91*f* and the return reservoir 91*r* to an atmospheric pressure and a mark "x" indicates a state where the pressure regulation mechanism 98 closes the feed reservoir 91*f* and the return reservoir 91*r* to the atmospheric pressure. In column "Negative Pressure Difference", a mark "○" indicates that the pressure regulation mechanism 98 performs the negative pressure difference applying operation and a mark "x" indicates that the pressure regulation mechanism 98 does not perform the negative pressure difference applying operation. In column "Main Valve", a mark "○" indicates that the main valve Vm is opened and a mark "x" indicates that the main valve Vm is closed. In column "Head Valves", a mark "○" indicates that the feed valves Vf and the return valves Vr are opened and a mark "x" indicates that the feed valves Vf and the return valves Vr are closed. In column "Purge", a mark "○" indicates that purging is performed and a mark "x" indicates that purging is not performed. Here, purging is an operation of forcibly draining the liquid L from the nozzles N of the discharge heads H.

When the liquid replacing operation is started, the liquid supply device 9 is in a state shown in FIG. 5 and each reservoir 91*f*, 91*r* of the liquid supply device 9 and the discharge heads H are filled with the liquid L1 (liquid L indicated by light dotted hatching). Further, the controller 99 causes the liquid L to be circulated along the normal circulation channel Co by causing the pressure regulation mechanism 98 to perform the negative pressure difference applying operation with the bypass valve Vb and the drain valve Vd closed while the feed valves Vf, the return valves Vr and the main valve Vm are opened (normal circulation). However, unlike the state of FIG. 5, the next liquid L2 (liquid L by dense dotted hatching in FIGS. 9 to 12) is prepared in the main reservoir 91*m*.

In Step S101, the controller 99 causes the pressure regulation mechanism 98 to stop the negative pressure difference applying operation. In this way, the negative pressure difference ΔP between the pressure Pf of the feed reservoir 91*f* and the pressure Pr of the return reservoir 91*r* is lost and the circulation of the liquid L1 along the normal circulation channel Co (normal circulation) is stopped. Further, the controller 99 also stops the circulation pump 95 as the negative pressure difference applying operation is stopped. Then, the controller 99 closes the feed valves Vf and the return valves Vr (head valves) (Step S102) and opens the bypass valve Vb (Step S103). Further, the controller 99 closes the main valve Vm and opens the feed reservoir 91*f* and the return reservoir 91*r* to the atmospheric pressure (Step S104). From this state, the controller 99 opens the drain valve Vd (Step S105).

Figure 9:
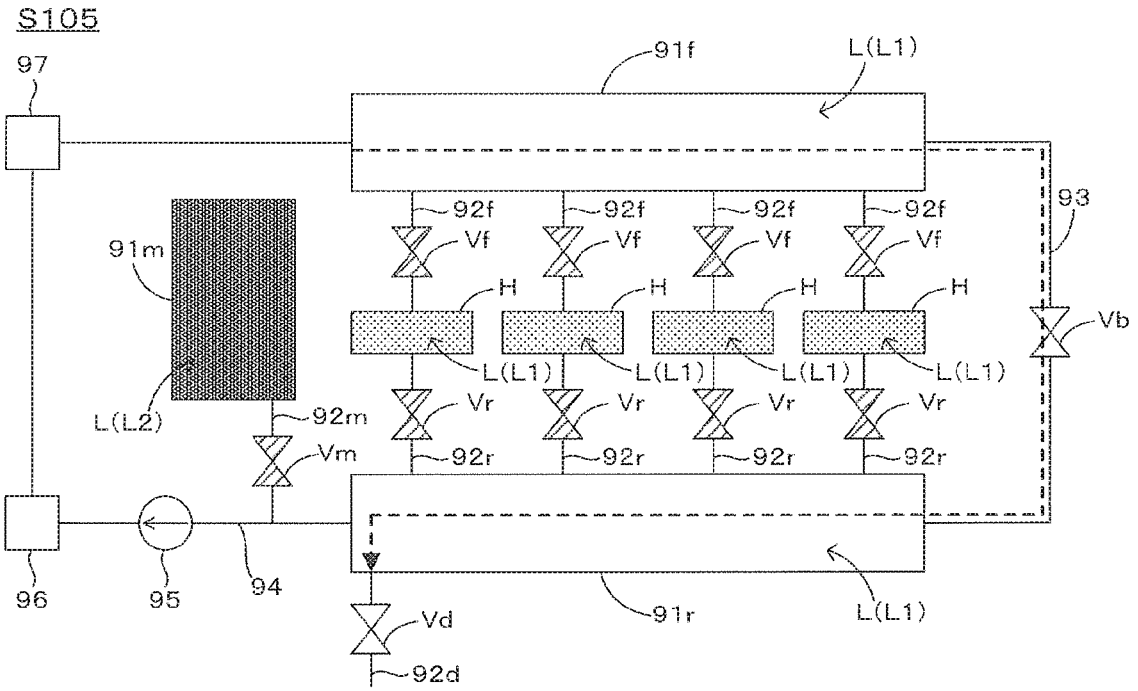
FIG. 9 is a diagram schematically showing operations performed in the liquid replacing operation of FIG. 7.

The bypass valve Vb and the drain valve Vd are opened with the feed reservoir 91*f* and the return reservoir 91*r* opened to the atmospheric pressure in this way. This causes the liquid L1 to be drained from the return reservoir 91*r* via the drain valve Vd and causes the liquid L1 flowed into the return reservoir 91*r* from the feed reservoir 91*f* via the bypass valve Vb to be drained from the drain pipe 92*d* (Step S105). In this way, the liquid L1 is drained from the feed reservoir 91*f* and the return reservoir 91*r* (liquid draining operation) as shown in FIG. 9. Note that since the feed valves Vf and the return valves Vr are closed during the liquid draining operation of draining the liquid L1, the inflow of the liquid L1 from the feed reservoir 91*f* and the return reservoir 91*r* to the discharge heads H is prohibited.

Figure 10:
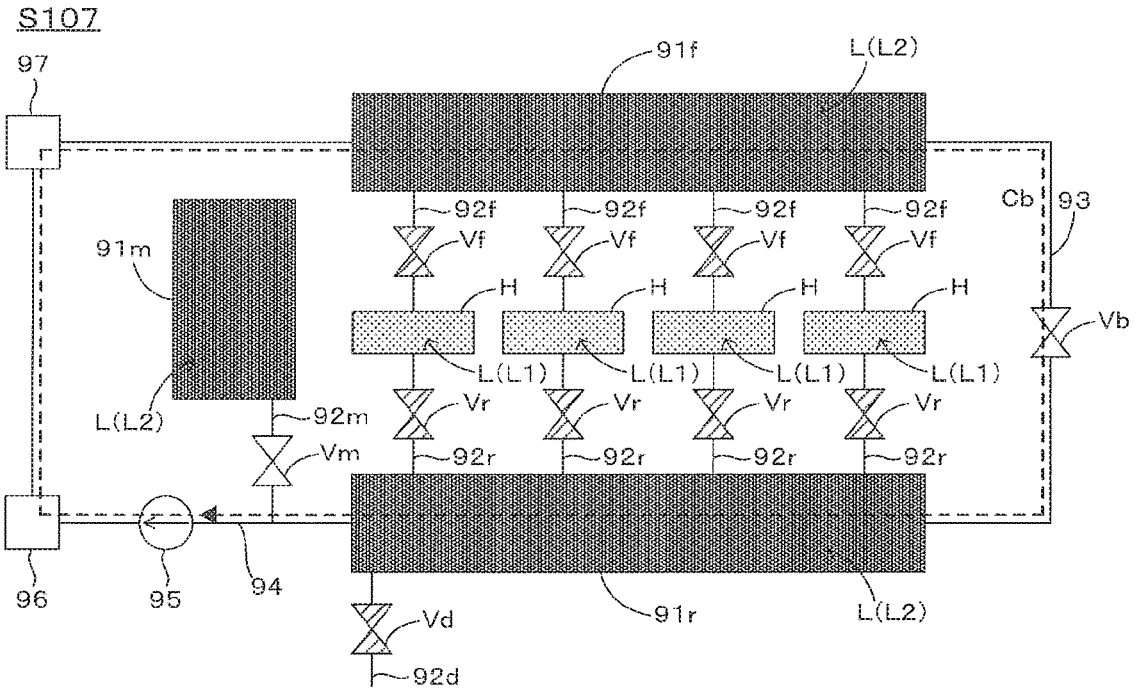
FIG. 10 is a diagram schematically showing operations performed in the liquid replacing operation of FIG. 7.

When the liquid draining operation is completed, the controller 99 causes the pressure regulation mechanism 98 to perform the negative pressure difference applying operation (Step S107) after opening the main valve Vm (Step S106). As this negative pressure difference applying operation is started, the operation of the circulation pump 95 is started, and the liquid L2 supplied from the main reservoir 91*m* to the reservoir communication pipe 94 is supplied to the feed reservoir 91*f* by the circulation pump 95. Further, the negative pressure difference ΔP is generated between the feed reservoir 91*f* and the return reservoir 91*r* by the start of the negative pressure difference applying operation. Since the feed valves Vf and the return valves Vr are closed and the bypass valve Vb is open at this time, the liquid L2 supplied to the feed reservoir 91*f* flows into the return reservoir 91*r* via the bypass communication pipe 93. In this way, as shown in FIG. 10, the liquid L2 is circulated along a bypass circulation channel Cb (broken line) which returns from the return reservoir 91*r* to the feed reservoir 91*f* via the reservoir communication pipe 94 after reaching the return reservoir 91*r* by way of the bypass communication pipe 93 from the feed reservoir 91*f* in Step S107 (bypass circulation). By this bypass circulation, the liquid L2 is filled into the feed reservoir 91*f* and the return reservoir 91*r*. Note that since the feed pipes 92*f* and the return pipes 92*r* are closed during the bypass circulation, the inflow of the liquid L2 into the discharge heads H from the feed reservoir 91*f* and the return reservoir 91*r* is prohibited.

The controller 99 causes the pressure regulation mechanism 98 to stop the negative pressure difference applying operation (Step S109) after continuing the bypass circulation for a predetermined time (Step S108). In this way, the negative pressure difference ΔP between the pressure Pf of the feed reservoir 91*f* and the pressure Pr of the return reservoir 91*r* is lost and the circulation of the liquid L2 along the bypass circulation channel Cb (bypass circulation) is stopped. Further, the controller 99 also stops the circulation pump 95 as the negative pressure difference applying operation is stopped. Then, the controller 99 opens the feed valves Vf and the return valves Vr (head valves) and closes the bypass valve Vb (Step S110).

In this state, the controller 99 causes the pressure regulation mechanism 98 to perform the purging (Step S111). That is, the pressure regulation mechanism 98 performs a positive pressure applying operation of applying a positive pressure to the feed reservoir 91*f* by the feed-side regulating part 98*f* and applying a positive pressure to the return reservoir 91*r* by the return-side regulating part 98*r*. At this time, the same positive pressures are applied to the feed reservoir 91*f* and the return reservoir 91*r*. By this positive pressure applying operation, a second liquid feeding operation is performed to supply the liquid L2 from the feed reservoir 91*f* to the liquid supply chambers Hc of the discharge heads H via the feed pipes 92*f* and supply the liquid L2 from the return reservoir 91*r* to the liquid supply chambers Hc of the discharge heads H via the return pipes 92*r*. Note that, as the second liquid feeding operation is performed, the liquid L2 flowed out from the feed reservoir 91*f* and the return reservoir 91*r* is replenished into each of the feed reservoir 91*f* and the return reservoir 91*r* from the main reservoir 91*m*.

Figure 11:
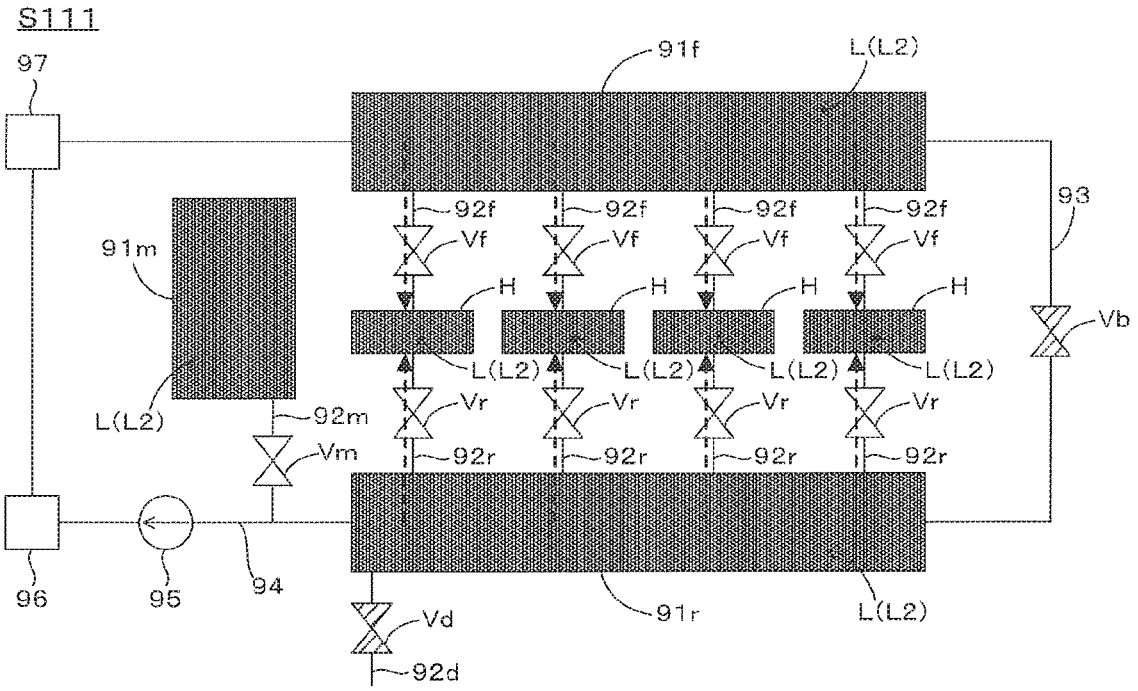
FIG. 11 is a diagram schematically showing operations performed in the liquid replacing operation of FIG. 7.

By the second liquid feeding operation, the liquid L2 flowed into the liquid supply chambers Hc of the discharge heads H drives out the liquid L1 in the liquid supply chambers Hc and the liquid L1 flows out from the nozzles N (purging). In this way, the liquid L1 is drained from the liquid supply chambers Hc of the discharge heads H and the liquid supply chambers Hc of the discharge heads H are filled with the liquid L2 as shown in FIG. 11. Further, this second liquid feeding operation is continued until the liquid L2 flows out from the nozzles N, following the outflow of the liquid L1 from the nozzles N. Further, wiping is performed for the discharge heads H having the liquids L1, L2 flowed out from the nozzles N. The wiping is an operation of wiping off the liquids L1, L2 from the discharge heads H by wipers.

Figure 12:
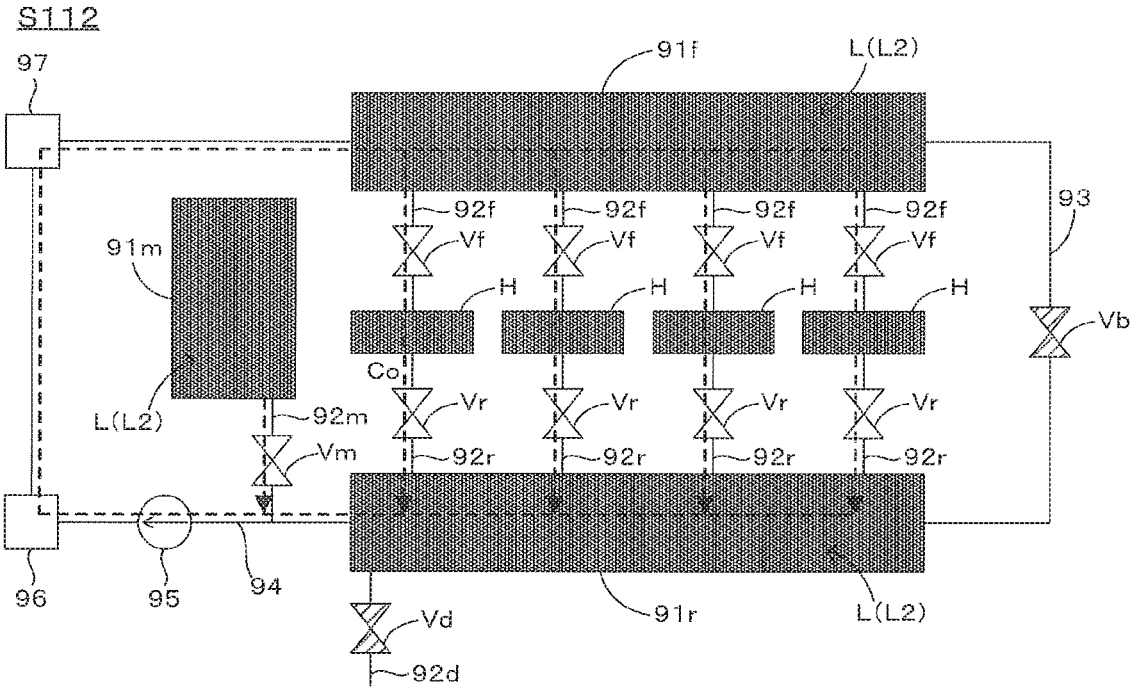
FIG. 12 is a diagram schematically showing operations performed in the liquid replacing operation of FIG. 7.

In Step S112, the controller 99 causes the pressure regulation mechanism 98 to stop the positive pressure applying operation and perform the negative pressure difference applying operation. At this time, since the feed valves Vf and the return valves Vr are open and the bypass valve Vb is closed, the normal circulation for the liquid L2 is carried out and the liquid L2 is circulated along the normal circulation channel Co (FIG. 12). Then, the controller 99 finishes the liquid replacing operation after continuing the normal circulation for a predetermined time (Step S113).

In the embodiment described above, the ink flowed into the discharge heads H from the feed reservoir 91*f* can be returned to the feed reservoir 91*f* by way of the return reservoir 91*r* by carrying out the normal circulation (FIG. 12, Step S112) of circulating the ink (liquid L) along the normal circulation channel Co. Thus, at the time of normal printing, the ink circulated along the normal circulation channel Co by the normal circulation can be discharged from the nozzles N of the discharge heads H. On the other hand, the liquid L flowed into the bypass communication pipe 93 from the feed reservoir 91*f* can be returned to the feed reservoir 91*f* by way of the return reservoir 91*r* by carrying out the bypass circulation (FIG. 10, Step S107) of circulating the liquid L along the bypass circulation channel Cb. Since this bypass communication pipe 93 bypasses the discharge heads H, the liquid L does not pass through the discharge heads H in the bypass circulation. As a result, the liquid L can be circulated between the feed reservoir 91*f* and the return reservoir 91*r* while the mixing of foreign substances into the discharge heads H from the respective reservoirs 91*f*, 91*r* is suppressed. Note that the foreign substances include minute aggregates gradually generated from the ink due to a load applied to the ink from the pump, for example, during the circulation of the ink.

Further, the liquid supply device 9 is provided with the reservoir communication pipe 94 (common channel) that feeds the liquid L from the return reservoir 91*r* to the feed reservoir 91*f* and is common to the normal circulation channel Co and the bypass circulation channel Cb. In both the normal circulation and the bypass circulation, the liquid L is returned from the return reservoir 91*r* to the feed reservoir 91*f* via the reservoir communication pipe 94. In such a configuration, the liquid L can be returned from the return reservoir 91*r* to the feed reservoir 91*f* via the reservoir communication pipe 94 in each circulation.

Further, the drain pipe 92*d* performs the liquid draining operation (FIG. 9, Steps S103 to S105) to drain the liquid L1 from the feed reservoir 91*f* and the return reservoir 91*r*, the main reservoir 91*m* performs the liquid supplying operation (Step S106) of supplying the liquid L2 to the reservoir communication pipe 94 after the liquid draining operation. Then, in Step S107, the controller 99 fills the liquid L2 into the feed reservoir 91*f* and the return reservoir 91*r* while circulating the liquid L2 supplied by the liquid supplying operation between the feed reservoir 91*f* and the return reservoir 91*r* by the bypass circulation along the bypass circulation channel Cb (reservoir filling process). Such a configuration is preferable in changing the liquid L from the liquid L1 to the liquid L2. Particularly, since the liquid L2 is circulated between the respective reservoirs 91*f*, 91*r* by the bypass circulation along the bypass circulation channel Cb after the liquid L1 is drained from the respective reservoirs 91*f*, 91*r*, the liquid L1 remaining in the reservoirs 91*f*, 91*r* without being drained can be dispersed in the liquid L2. Therefore, the liquid L1 can be quickly drained as the liquid L2 is drained (e.g. Step S111) thereafter, and the liquid L1 can be prevented from continuing to remain in the reservoirs 91*f*, 91*r* for a long time.

Further, the pressure regulation mechanism 98 (liquid feed unit) performs the second liquid feeding operation of supplying the liquid L2 from the feed reservoir 91*f* to the discharge heads H via the feed pipes 92*f* and supplying the liquid L2 from the return reservoir 91*r* to the discharge heads H via the return pipes 92*r* (FIG. 11, Step S111). Then, the controller 99 causes the pressure regulation mechanism 98 to perform the second liquid feeding operation after the reservoir filling process (Step S107), thereby performing a head filling process (FIG. 11, Step S111) of filling the liquid L2 into the discharge heads H while draining the liquid L1 remaining in the discharge heads H from the nozzles N by the liquid L2. In such a configuration, the liquid L filled in the discharge heads H can be replaced from the liquid L1 to the liquid L2.

Further, in the head filling process (Step S111), the liquid L2 is drained from the nozzles N, following the liquid L1. In such a configuration, the liquid L1 dispersed in the liquid L2 can be quickly drained together with the liquid L2.

Further, the controller 99 causes the liquid L2 to be circulated between the feed reservoir 91*f* and the return reservoir 91*r* by the normal circulation along the normal circulation channel Co (FIG. 12, Step S112) after the head filling process (Step S111). In such a configuration, the liquid L1 remaining in the discharge heads H without being drained can be dispersed in the liquid L2. Therefore, the liquid L1 can be quickly drained as the liquid L2 is drained thereafter (e.g. purging or the like performed later as printing is started), and the liquid L1 can be prevented from continuing to remain in the discharge heads H for a long time.

In the embodiment described above, the pre-stage printing apparatus 2 or post-stage printing apparatus 6 corresponds to an example of a "printing apparatus" of the invention, the feed reservoir 91*f* corresponds to an example of a "feed reservoir" of the invention, the main reservoir 91*m* corresponds to an example of a "liquid supply unit" of the invention, the return reservoir 91*r* corresponds to an example of a "return reservoir" of the invention, the drain pipe 92*d* corresponds to an example of a "liquid drain unit" of the invention, the feed pipe 92*f* corresponds to an example of a "feed channel" of the invention, the return pipe 92*r* corresponds to an example of a "return channel" of the invention, the bypass communication pipe 93 corresponds to an example of a "bypass channel" of the invention, the reservoir communication pipe 94 corresponds to an example of a "common channel" of the invention, the pressure regulation mechanism 98 corresponds to an example of a "liquid feed unit" of the invention, the controller 99 corresponds to an example of a "control unit" of the invention, the discharge head H corresponds to an example of a "discharge head" of the invention, the liquid L, L1, L2 corresponds to an example of a "liquid" of the invention, the liquid L1 corresponds to an example of a "first liquid" of the invention, the liquid L2 corresponds to an example of a "second liquid" of the invention, and the nozzle N corresponds to an example of a "nozzle" of the invention.

Note that the invention is not limited to the above embodiment and various changes other than the aforementioned ones can be made without departing from the gist of the invention. For example, the liquid drainage from the reservoirs 91*f*, 91*r* may be individually performed by providing each of the feed reservoir 91*f* and the return reservoir 91*r* with the drain pipe 92*d*.

Further, the replenishment destination of the liquid L from the main reservoir 91*m* is not limited to the reservoir communication pipe 94. Therefore, the liquid L may be replenished into the feed reservoir 91*f* via the liquid supply pipe 92*m* from the main reservoir 91*m* or may be replenished into the return reservoir 91*r* via the liquid supply pipe 92*m* from the main reservoir 91*m*.

Further, filters may be provided to the feed pipes 92*f* communicating with/connecting the discharge heads H and the feed reservoir 91*f*. In such a configuration, the mixing of foreign substances into the discharge heads H can be further suppressed and the number of exchanges of the filters can be suppressed by suppressing clogging due to the adhesion of foreign substances to the filters.

Further, the types of the color inks to be discharged to the printing medium M in the pre-stage printing apparatus 2 are not limited to the above six colors.

Further, a printing apparatus for discharging a white ink may be provided upstream of the pre-stage printing apparatus 2 in the conveying direction Am, and the color inks may be discharged to the printing medium M after the white ink is discharged to the printing medium M.

Further, the white ink may be printed on the printing medium M by analog printing like flexographic printing or gravure printing.

Further, the pre-stage printing apparatus 2 may stop the printing medium M on a platen and discharge the color inks from the nozzles N while the print bars B are operated in an orthogonal direction Ar.

Further, the material of the printing medium M is not limited to a film and may be paper or the like.

Further, the types of the inks are not limited to water-based inks and may be latex inks, solvent inks or UV (UltraViolet) inks. In the case of using UV inks, light irradiation apparatuses for irradiating ultraviolet rays to the UV inks on the printing medium M are arranged instead of the pre-stage drier 4 and the post-stage drier 8.

The invention is applicable to printing techniques in general.

As described above, the printing apparatus may further comprise a common channel configured to feed the liquid from the return reservoir to the feed reservoir, wherein: the liquid is returned from the return reservoir to the feed reservoir via the common channel in both the normal circulation and the bypass circulation. In such a configuration, the liquid can be returned from the return reservoir to the feed reservoir via the common channel in each circulation.

The printing apparatus may further comprises: a liquid drain unit which performs a liquid draining operation of draining a first liquid belonging to one type of the liquid from the feed reservoir and the return reservoir; and a liquid supply unit which performs a liquid supplying operation of supplying a second liquid belonging to another type of the liquid different from the one type to any one of the return reservoir, the common channel and the feed reservoir after the liquid draining operation, wherein: the control unit performs a reservoir filling process of filling the second liquid into the feed reservoir and the return reservoir while circulating the second liquid supplied by the liquid supplying operation between the feed reservoir and the return reservoir by the bypass circulation. Such a configuration is preferable in changing the liquid from the first liquid to the second liquid. Particularly, since the second liquid is circulated between the respective reservoirs by the bypass circulation after the first liquid is drained from the respective reservoirs, the first liquid remaining in the reservoirs without being drained can be dispersed in the second liquid. Therefore, the first liquid can be quickly drained as the second liquid is drained thereafter, and the first liquid can be prevented from continuing to remain in the reservoirs for a long time.

The printing apparatus may be configured so that the liquid feed unit performs a second liquid feeding operation of supplying the second liquid from the feed reservoir to the discharge head via the feed channel and supplying the second liquid from the return reservoir to the discharge head via the return channel, and the control unit performs a head filling process of filling the second liquid into the discharge head while draining the first liquid remaining in the discharge head from the nozzle by causing the liquid feed unit to perform the second liquid feeding operation after the reservoir filling process. In such a configuration, the liquid to be filled into the discharge head can be replaced from the first liquid to the second liquid.

The printing apparatus may be configured so that the second liquid is drained from the nozzle, following the first liquid, in the head filling process. In such a configuration, the first liquid dispersed in the second liquid can be quickly drained together with the second liquid.

The printing apparatus may be configured so that the control unit circulates the second liquid between the feed reservoir and the return reservoir by the normal circulation after the head filling process. In such a configuration, the first liquid remaining in the discharge head without being drained can be dispersed in the second liquid. Therefore, the first liquid can be quickly drained as the second liquid is drained thereafter, and the first liquid can be prevented from continuing to remain in the discharge head for a long time.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printing apparatus, comprising:

a feed reservoir;

a discharge head which discharges a liquid supplied from the feed reservoir via a feed channel from a nozzle;

a return reservoir which recovers the liquid from the discharge head via a return channel;

a bypass channel configured to feed the liquid from the feed reservoir to the return reservoir by bypassing the discharge head;

a liquid feed unit which performs a first liquid feeding operation of feeding the liquid from the feed reservoir to the return reservoir;

a control unit which selectively carries out a normal circulation of returning the liquid flowed into the discharge head from the feed reservoir to the feed reservoir by way of the return reservoir by causing the liquid feed unit to perform the first liquid feeding operation with the feed channel and the return channel opened while the bypass channel is closed and a bypass circulation of returning the liquid flowed into the bypass channel from the feed reservoir to the feed reservoir by way of the return reservoir by causing the liquid feed unit to perform the first liquid feeding operation with the bypass channel opened while the feed channel and the return channel are closed;

a common channel configured to feed the liquid from the return reservoir to the feed reservoir, wherein the liquid is returned from the return reservoir to the feed reservoir via the common channel in both the normal circulation and the bypass circulation;

a liquid drain unit which performs a liquid draining operation of draining a first liquid belonging to one type of the liquid from the feed reservoir and the return reservoir; and a liquid supply unit which performs a liquid supplying operation of supplying a second liquid belonging to another type of the liquid different from the one type to any one of the return reservoir, the common channel, and the feed reservoir after the liquid draining operation, wherein the control unit performs a reservoir filling process of filling the second liquid into the feed reservoir and the return reservoir while circulating the second liquid supplied by the liquid supplying operation between the feed reservoir and the return reservoir by the bypass circulation, wherein the liquid feed unit performs a second liquid feeding operation of supplying the second liquid from the feed reservoir to the discharge head via the feed channel and supplying the second liquid from the return reservoir to the discharge head via the return channel, wherein the control unit performs a head filling process of filling the second liquid into the discharge head while draining the first liquid remaining in the discharge head from the nozzle by causing the liquid feed unit to perform the second liquid feeding operation after the reservoir filling process, and wherein the second liquid is drained from the nozzle, following the first liquid, in the head filling process.

2. The printing apparatus according to claim 1, wherein the control unit circulates the second liquid between the feed reservoir and the return reservoir by the normal circulation after the head filling process.

3. A liquid circulation method in a printing apparatus for supplying a liquid from a feed reservoir via a feed channel to a discharge head which discharges the liquid and recovering the liquid from the discharge head via a return channel to a return reservoir, comprising:

carrying out a normal circulation of returning the liquid flowed into the discharge head from the feed reservoir to the feed reservoir by way of the return reservoir with the feed channel and the return channel opened while a bypass channel which feeds the liquid from the feed reservoir to the return reservoir by bypassing the discharge head is closed;

carrying out a bypass circulation of returning the liquid flowed into the bypass channel from the feed reservoir to the feed reservoir by way of the return reservoir with the bypass channel opened while the feed channel and the return channel are closed;

wherein the liquid is returned from the return reservoir to the feed reservoir via a common channel in both the normal circulation and the bypass circulation, the common channel being configured to feed the liquid from the return reservoir to the feed reservoir, wherein the liquid circulation method further comprising:

performing a liquid draining operation of draining a first liquid belonging to one type of the liquid from the feed reservoir and the return reservoir;

performing a liquid supplying operation of supplying a second liquid belonging to another type of the liquid different from the one type to any one of the return reservoir, the common channel and the feed reservoir after the liquid draining operation;

performing a reservoir filling process of filling the second liquid into the feed reservoir and the return reservoir while circulating the second liquid supplied by the liquid supplying operation between the feed reservoir and the return reservoir by the bypass circulation;

performing a liquid feeding operation of supplying the second liquid from the feed reservoir to the discharge head via the feed channel and supplying the second liquid from the return reservoir to the discharge head via the return channel;

performing a head filling process of filling the second liquid into the discharge head while draining the first liquid remaining in the discharge head from a nozzle by performing the liquid feeding operation after the reservoir filling process, and wherein the head filling process includes draining the second liquid from the nozzle, following the first liquid.

* * * * *